US010408163B2

(12) United States Patent
Kia et al.

(10) Patent No.: US 10,408,163 B2
(45) Date of Patent: Sep. 10, 2019

(54) POLYMERIC COMPOSITE ENGINE ASSEMBLY AND METHODS OF HEATING AND COOLING SAID ASSEMBLY

(71) Applicant: GM Global Technology Operations LLC, Detroit, MI (US)

(72) Inventors: Hamid G. Kia, Bloomfield Hills, MI (US); Mark W. Verbrugge, Troy, MI (US); Anthony M. Coppola, Royal Oak, MI (US); Paul M. Najt, Bloomfield Hills, MI (US); Michael A. Potter, Grass Lake, MI (US); Russell P. Durrett, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 147 days.

(21) Appl. No.: 15/225,025

(22) Filed: Aug. 1, 2016

(65) Prior Publication Data

US 2018/0030922 A1 Feb. 1, 2018

(51) Int. Cl.
*F02F 7/00* (2006.01)
*F02F 1/00* (2006.01)
(Continued)

(52) U.S. Cl.
CPC ..... *F02F 7/0085* (2013.01); *F02F 1/004* (2013.01); *F02F 1/16* (2013.01); *F02F 1/36* (2013.01);
(Continued)

(58) Field of Classification Search
CPC ..... F02F 1/004; F02F 1/16; F02F 1/36; F02F 7/007; F02F 7/0085; F02F 1/10;
(Continued)

(56) References Cited

U.S. PATENT DOCUMENTS 1,534,411 A 4/1925 Potter
3,481,316 A * 12/1969 Olson ..... F02F 1/14 123/193.1
(Continued)

FOREIGN PATENT DOCUMENTS

CN 101967361 A 2/2011
CN 107672189 A 2/2018
(Continued)

OTHER PUBLICATIONS

Guimond et al.; "Composite V-6 Diesel Engine Concept;" SAE Technical Paper 920084; Feb. 1992; 8 pages.
(Continued)

*Primary Examiner* — Grant Moubry
*Assistant Examiner* — Ruben Picon-Feliciano
(74) *Attorney, Agent, or Firm* — Harness, Dickey & Pierce, P.L.C.

(57) ABSTRACT

Engine assemblies and methods of heating and/or cooling the engine assemblies are provided. The engine assembly has a metal liner defining a cylindrical region for receiving a piston, a polymeric composite housing disposed around at least a portion of the exterior surface of the metal liner, and a metal cylinder head. The polymeric composite housing comprises a polymer and a plurality of reinforcing fibers and at least one of: a plurality of microchannels for receiving a heat transfer fluid for heating and/or cooling the engine assembly; and at least one wire for heating the engine assembly.

20 Claims, 6 Drawing Sheets

(51) Int. Cl.
*F02F 1/36* (2006.01)
*F02F 1/16* (2006.01)

(52) U.S. Cl.
CPC ..... *F02F 7/007* (2013.01); *F05C 2225/00* (2013.01); *F05C 2251/048* (2013.01); *F05C 2253/16* (2013.01)

(58) Field of Classification Search
CPC ..... F02F 1/14; F02F 11/005; F05C 2225/00; F05C 2251/048; F05C 2253/16; F01P 3/02; F01P 2003/021; F16J 10/04
See application file for complete search history.

(56) References Cited

U.S. PATENT DOCUMENTS

| | | | | |
|---|---|---|---|---|
| 4,446,827 | A | 5/1984 | Kubozuka | |
| 4,446,906 | A | 5/1984 | Ackerman et al. | |
| 4,450,610 | A | 5/1984 | Schaper | |
| 4,659,268 | A | 4/1987 | Del Mundo et al. | |
| 4,726,334 | A | 2/1988 | Holtzberg et al. | |
| 4,848,292 | A | 7/1989 | Holtzberg | |
| 4,901,692 | A | 2/1990 | Madden | |
| 4,930,470 | A | 6/1990 | Kabat et al. | |
| 5,062,393 | A | 11/1991 | Smith et al. | |
| 5,083,537 | A | 1/1992 | Onofrio et al. | |
| 5,176,456 | A | 1/1993 | Takebayashi et al. | |
| 5,207,120 | A | 5/1993 | Arnold et al. | |
| 5,259,677 | A | 11/1993 | Degrange et al. | |
| 5,301,423 | A * | 4/1994 | Clark | B22C 9/103 164/137 |
| 5,370,087 | A | 12/1994 | Guimond et al. | |
| 5,435,059 | A | 7/1995 | Chawla | |
| 5,737,838 | A | 4/1998 | Niimi et al. | |
| 5,922,472 | A | 7/1999 | Keener | |
| 5,947,667 | A | 9/1999 | Cassatt et al. | |
| 6,134,881 | A | 10/2000 | Strasser et al. | |
| 6,223,702 | B1 | 5/2001 | Achenbach et al. | |
| 6,412,366 | B1 | 7/2002 | Leith | |
| 6,684,844 | B1 * | 2/2004 | Wang | F02F 1/20 123/193.1 |
| 6,959,683 | B2 | 11/2005 | Gokan | |
| 7,191,770 | B1 * | 3/2007 | Anderson | F02F 1/004 123/193.2 |
| 7,367,303 | B2 | 5/2008 | Yamamoto et al. | |
| 7,819,462 | B1 | 10/2010 | Owens | |
| 8,033,592 | B2 | 10/2011 | Hsu et al. | |
| 8,109,492 | B2 | 2/2012 | Winocur | |
| 8,757,028 | B2 | 6/2014 | Broughton et al. | |
| 8,961,724 | B2 | 2/2015 | Polewarczyk et al. | |
| 9,227,673 | B2 | 1/2016 | Berger et al. | |
| 9,254,634 | B2 | 2/2016 | Arbesman et al. | |
| 9,302,733 | B2 | 4/2016 | Schlanger | |
| 9,416,749 | B2 | 8/2016 | Maki et al. | |
| 9,463,502 | B2 | 10/2016 | Arbesman et al. | |
| 9,527,132 | B2 | 12/2016 | Lowe et al. | |
| 9,707,733 | B2 | 7/2017 | Arbesman et al. | |
| 10,125,809 | B2 | 11/2018 | Coppola et al. | |
| 10,132,270 | B2 | 11/2018 | Coppola et al. | |
| 10,267,261 | B2 | 4/2019 | Coppola et al. | |
| 2002/0104505 | A1 | 8/2002 | Ericson | |
| 2003/0183983 | A1 | 10/2003 | Schmidt | |
| 2004/0226393 | A1 | 11/2004 | Hong | |
| 2005/0128705 | A1 | 6/2005 | Chu et al. | |
| 2006/0102110 | A1 | 5/2006 | Takenaka et al. | |
| 2007/0277645 | A1 | 12/2007 | Weisskopf et al. | |
| 2009/0126180 | A1 | 5/2009 | Keener | |
| 2009/0223479 | A1 | 9/2009 | Schoell | |
| 2011/0174246 | A1 | 7/2011 | Graf et al. | |
| 2011/0300333 | A1 | 12/2011 | Kallinen | |
| 2012/0015134 | A1 | 1/2012 | Walker et al. | |
| 2012/0085313 | A1 | 4/2012 | Reisser | |
| 2013/0018988 | A1 | 1/2013 | Peek | |
| 2013/0065042 | A1 | 3/2013 | Esser-Kahn et al. | |
| 2013/0189888 | A1 | 7/2013 | Patrick et al. | |
| 2014/0072386 | A1 | 3/2014 | Baugh, Sr. | |
| 2014/0295323 | A1 | 10/2014 | Schulze | |
| 2015/0159581 | A1 | 6/2015 | Maki et al. | |
| 2016/0084295 | A1 | 3/2016 | Murrish et al. | |
| 2016/0230696 | A1 | 8/2016 | Williams et al. | |
| 2016/0264082 | A1 | 9/2016 | Berger et al. | |
| 2017/0023008 | A1 | 1/2017 | Roche | |
| 2017/0074205 | A1 | 3/2017 | Maki et al. | |
| 2018/0029316 | A1 | 2/2018 | Coppola et al. | |
| 2018/0030920 | A1 | 2/2018 | Wicks et al. | |
| 2018/0030923 | A1 | 2/2018 | Coppola et al. | |
| 2018/0030924 | A1 | 2/2018 | Coppola et al. | |
| 2018/0031027 | A1 | 2/2018 | Coppola et al. | |
| 2018/0037510 | A1 | 2/2018 | Durrett et al. | |
| 2018/0038276 | A1 | 2/2018 | Durrett et al. | |
| 2018/0038308 | A1 | 2/2018 | Durrett et al. | |
| 2018/0186144 | A1 | 7/2018 | Durrett et al. | |
| 2019/0001587 | A1 | 1/2019 | Coppola et al. | |
| 2019/0032700 | A1 | 1/2019 | Coppola et al. | |
| 2019/0084370 | A1 | 3/2019 | Coppola et al. | |

FOREIGN PATENT DOCUMENTS

| | | | | |
|---|---|---|---|---|
| CN | 107672196 | A | 2/2018 | |
| CN | 107676188 | A | 2/2018 | |
| CN | 107676189 | A | 2/2018 | |
| CN | 107676370 | A | 2/2018 | |
| DE | 3011358 | A1 | 10/1981 | |
| DE | 3013135 | A1 | 10/1981 | |
| DE | 19818589 | A1 | 11/1999 | |
| DE | 102012018330 | A1 | 8/2013 | |
| DE | 102013015431 | A1 | 3/2015 | |
| DE | 102014224827 | A1 | 6/2015 | |
| DE | 102017213313 | A1 | 2/2018 | |
| DE | 102017213315 | A1 | 2/2018 | |
| DE | 102017213316 | A1 | 2/2018 | |
| DE | 102017213317 | A1 | 2/2018 | |
| DE | 102017213319 | A1 | 2/2018 | |
| EP | 03411723 | A2 | 11/1989 | |
| EP | 0345424 | A1 | 12/1989 | |
| EP | 0361367 | A2 | 4/1990 | |
| EP | 0361367 | A2 * | 4/1990 | C08K 7/02 |
| EP | 0690956 | B1 | 9/1999 | |
| FR | 1593248 | A | 5/1970 | |
| JP | H0218405 | A | 1/1990 | |
| JP | 2012192543 | A | 10/2012 | |
| WO | 9520102 | A1 | 7/1995 | |
| WO | 2008085026 | A1 | 7/2008 | |
| WO | WO-20120117876 | A1 | 9/2012 | |
| WO | WO-2014153065 | A1 | 9/2014 | |

OTHER PUBLICATIONS

Esser-Kahn et al.; "Three-Dimensional Microvascular Fiber-Reinforced Composites;" Advanced Materials; vol. 23; 2011; pp. 3654-3658.

Brosius et al.; "Phenolics for High Temperature Applications in Small Engine Technologies (Cost Effective Performance Advantages);" SAE Technical Paper 951809; 1995; pp. 405-414.

Buckley et al.; "A Prediction of Weight Reduction and Performance Improvements Attainable through the use of Fiber Reinforced Composites in I.C. Engines;" SAE Technical Paper 2005-01-3693; Oct. 2005; 17 pages.

"Dow Introduces Bonding Process;" Materials Today; http://www.materialstoday.com/carbon-fiber/news/dow-introduces-bonding process; May 10, 2016; 1 page.

First Office Action in German Application No. 102017213316.3 from the German Patent Office dated Apr. 4, 2018 and correspondence from Manitz, Finsterwald & Partner summarizing the First Office Action; 6 pages.

Coppola, Anthony M. et al., U.S. Appl. No. 15/981,190, filed May 16, 2018 entitled "Vascular Polymeric Assembly," 40 pages.

Coppola, Anthony M. et al., U.S. Appl. No. 15/989,988, filed May 25, 2018 entitled "Apparatus for Cooling an Electric Motor and Method of Making the Same," 69 pages.

(56) References Cited

OTHER PUBLICATIONS

Coppola, Anthony M. et al., U.S. Appl. No. 16/148,634, filed Oct. 1, 2018 entitled "Assemblies Having Enhanced Heat Transfer Through Vascular Channels and Methods of Manufacturing Assemblies Having Vascular Channels," 67 pages.
First Office Action in Chinese Patent Application No. 201710645156.9 dated Feb. 15, 2019 with English language machine translation, 9 pages.
First Office Action in Chinese Patent Application No. 201710647860.8 dated Jan. 28, 2019 with English language machine translation, 10 pages.
First Office Action in Chinese Patent Application No. 201710649399.X dated Mar. 14, 2019 with English language machine translation, 14 pages.
First Office Action in Chinese Patent Application No. 201710645761.6 dated Mar. 19, 2019 with correspondence dated Mar. 26, 2019 from China Patent Agent (H.K.) Ltd. summarizing contents, 9 pages.
U.S. Appl. No. 15/225,037, filed Aug. 1, 2016, Anthony M. Coppola et al.
U.S. Appl. No. 15/225,051, filed Aug. 1, 2016, Anthony M. Coppola et al.
U.S. Appl. No. 15/225,066, filed Aug. 1, 2016, Anthony M. Coppola et al.
U.S. Appl. No. 15/225,080, filed Aug. 1, 2016, Anthony M. Coppola et al.
Coppola, Anthony M. et al., U.S. Appl. No. 16/108,449, filed Aug. 22, 2018 entitled "Polymeric and Metal Cylinder Head and Method of Making the Same," 67 pages.
Second Office Action in German Application No. 102017213316.3 from the German Patent Office dated Jun. 7, 2018 and correspondence from Manitz, Finsterwald & Partner summarizing contents; 6 pages.

* cited by examiner

POLYMERIC COMPOSITE ENGINE ASSEMBLY AND METHODS OF HEATING AND COOLING SAID ASSEMBLY

FIELD

The present disclosure relates to minimizing mass, enhancing heat transfer, and increasing durability and longevity of engine assemblies by using strategic incorporation of polymeric composites, for example, by incorporating polymeric composites having microchannels or wires formed therein for heating and cooling engine assemblies.

BACKGROUND

This section provides background information related to the present disclosure which is not necessarily prior art.

Traditionally, engine components for automotive applications have been made of metals, such as steel and iron. Metals components are robust, typically having good ductility, durability, strength and impact resistance. While metals have performed as acceptable engine components, they have a distinct disadvantage in being heavy and reducing gravimetric efficiency, performance and power of a vehicle thereby reducing fuel economy of the vehicle.

Weight reduction for increased fuel economy in vehicles has spurred the use of various lightweight metal components, such as aluminum and magnesium alloys as well as use of light-weight reinforced composite materials. While use of such lightweight materials can serve to reduce overall weight and generally may improve fuel efficiency, issues can arise when using such materials in an engine assembly due to high operating temperatures associated with the engine assembly. For example, the lightweight metal components can also have relatively high linear coefficients of thermal expansion, as compared to traditional steel or ceramic materials. In engine assemblies, the use of such lightweight metals can cause uneven thermal expansion under certain thermal operating conditions relative to adjacent components having lower linear coefficients of thermal expansion, like steel or ceramic materials, resulting in separation of components and decreased performance. Additionally, lightweight reinforced composite materials may have strength limitations, such as diminished tensile strength, and they can degrade after continuous exposure to high temperatures. Thus, lightweight engine assemblies having increased durability under high temperature operating conditions along with enhanced methods of heat transfer (e.g., heating and cooling) for such engine assemblies are needed to further improve efficiency of operation and fuel economy.

SUMMARY

This section provides a general summary of the disclosure, and is not a comprehensive disclosure of its full scope or all of its features.

In certain aspects, the present disclosure provides an engine assembly. The engine assembly may comprise a metal liner defining a cylindrical region for receiving a piston, wherein the metal liner has an interior surface, an opposing exterior surface, a first terminal surface and an opposing second terminal surface. The engine assembly may further comprise a polymeric composite housing disposed around at least a portion of the exterior surface of the metal liner, wherein the polymeric composite housing comprises a polymer and a plurality of reinforcing fibers and at least one of: (i) a plurality of microchannels for receiving a heat transfer fluid for heating and/or cooling the engine assembly; and (ii) at least one wire for heating the engine assembly. The engine assembly may further comprise a metal cylinder head having a fifth terminal surface and an opposing sixth terminal surface, wherein the sixth terminal surface of the metal cylinder head is adjacent to the first terminal surface of the metal liner.

In other aspects, the present disclosure provides a method for heating and/or cooling an engine assembly. The method may comprise one or more of the following: (i) circulating a heat transfer fluid for heating or cooling the engine assembly through a plurality a microchannels disposed in a polymeric composite housing comprising a polymer and a plurality reinforcing fibers disposed around at least a portion of an exterior surface of a metal liner, wherein the metal liner defines a cylindrical region for receiving a piston; and (ii) applying an electrical current to at least one wire disposed in the polymeric composite housing for heating the engine assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 3*a*-3*e* show schematics illustrating formation of microchannels in a polymeric composite according to certain aspects of the present disclosure.

Figure 4:
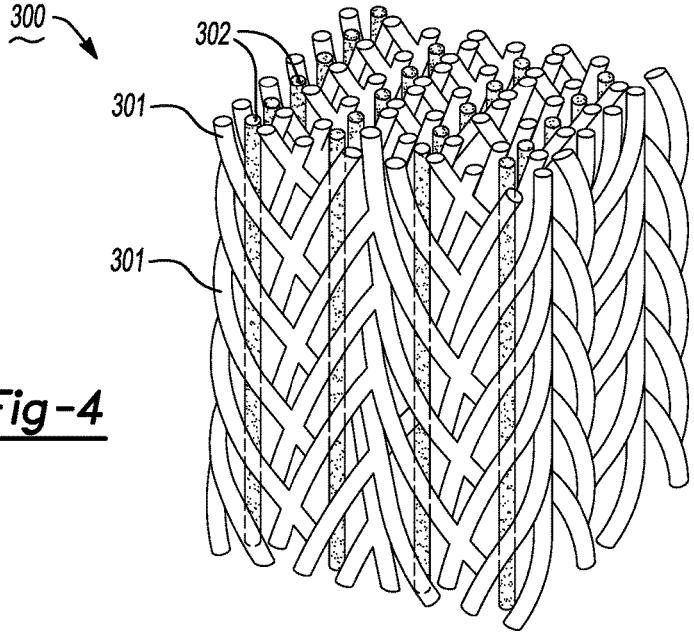

FIG. 4 shows a polymeric composite including reinforcing fibers and at least one wire.

Figure 5:
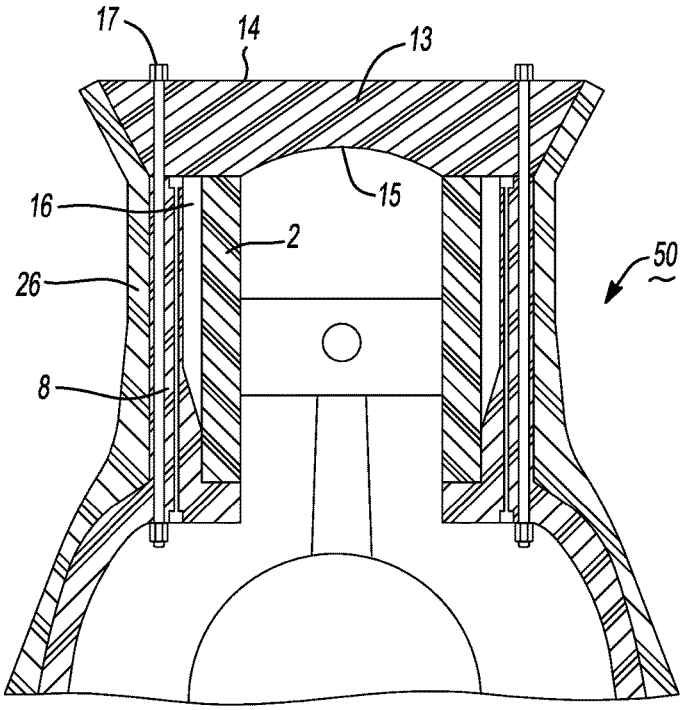

FIG. 5 shows a cross-sectional view of an alternative engine assembly according to certain aspects of the present disclosure.

Figure 6A:
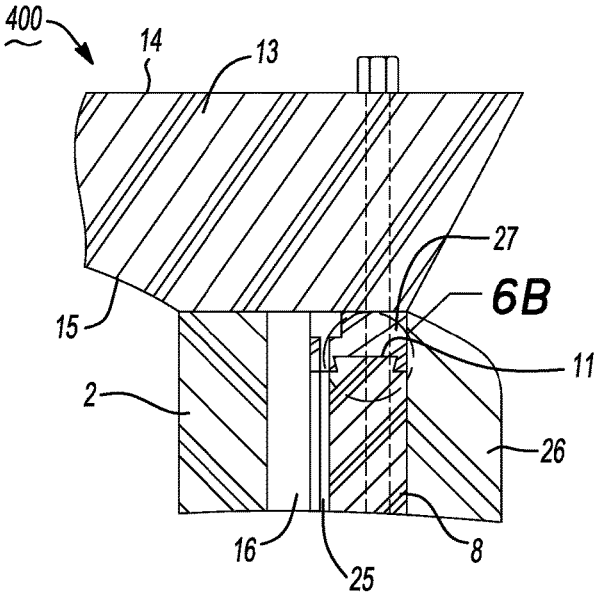
Figure 6B:
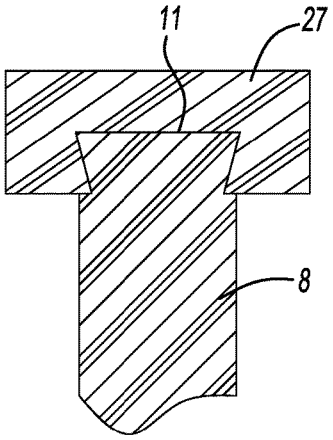

FIGS. 6*a* and 6*b* show a cross-sectional view of an alternative engine assembly according to certain aspects of the present disclosure.

Figure 7:
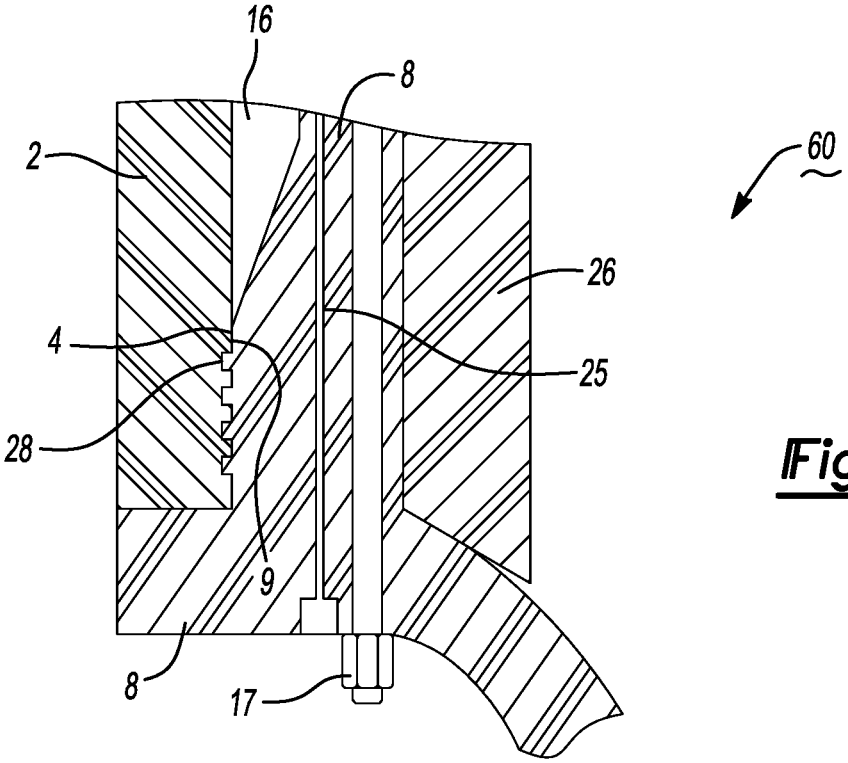

FIG. 7 shows a cross-sectional view of an alternative engine assembly according to certain aspects of the present disclosure.

Figure 8:
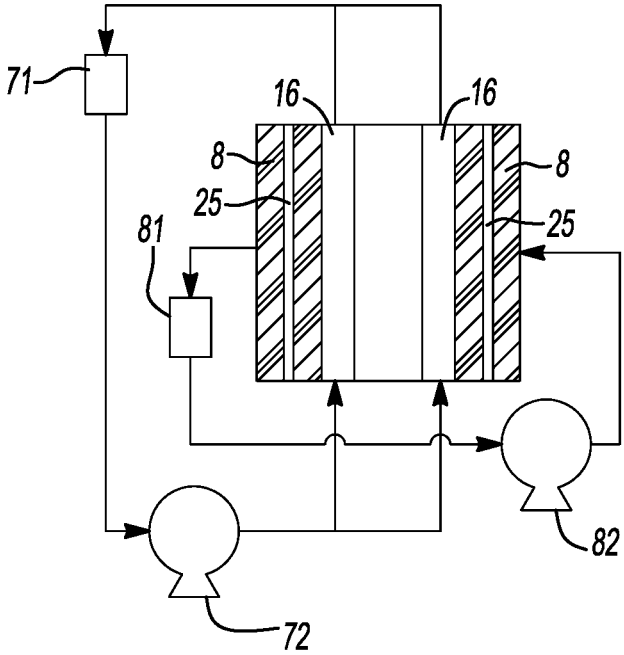

FIG. 8 show a schematic illustrating the heating and/or cooling of the engine assembly.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," "attached to" or "coupled to" another element or layer, it may be directly on, engaged, connected, attached or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," and the like). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It should be understood for any recitation of a method, composition, device, or system that "comprises" certain steps, ingredients, or features, that in certain alternative variations, it is also contemplated that such a method, composition, device, or system may also "consist essentially of" the enumerated steps, ingredients, or features, so that any other steps, ingredients, or features that would materially alter the basic and novel characteristics of the invention are excluded therefrom.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

In addition, disclosure of ranges includes disclosure of all values and further divided ranges within the entire range, including endpoints and sub-ranges given for the ranges.

In a vehicle, such as an automobile, an engine is a power source that produces torque for propulsion. The engine is an assembly of parts, including cylinder liners, pistons, crankshafts, combustion chambers, and the like. In a four stroke internal combustion engine each piston has an intake stroke, a compression stroke, a power stroke, and an exhaust stroke. During the intake stroke, a piston moves downward and an inlet valve is opened to permit a gaseous air mixture to fill a combustion chamber. During the compression stroke, intake and exhaust valves are closed and the piston moves upward to compress the gaseous air mixture. During the power stroke, the gaseous air mixture in the combustion chamber is ignited by a spark plug and the rapidly expanding combustion gases drive the piston downward. During the exhaust stroke, the exhaust valve is opened and the piston moves upward to discharge the combustion gases (exhaust gases). Overall, during internal combustion, the engine components may be subjected to varying amounts of stresses as well as varying temperatures due to the exothermic combustion reactions occurring in the engine block.

As discussed above, as weight of engine components within a given engine architecture increases, power, fuel economy, and efficiency may decrease. Thus, it is desirable to include various lightweight components, such as lightweight metals and lightweight composite material, in engine assemblies instead of the traditional steel and/or iron components to decrease weight of the engine but also to maintain structural integrity of the engine. In addition to inclusion of lightweight materials, suitable cooling and/or heating of the engine assembly is also desirable to maintain longevity of the engine assembly and to increase fuel economy.

Thus, engine assemblies for use in vehicle assemblies are provided herein which include a combination of components formed of lightweight materials (e.g., polymeric composite materials) and traditional materials and having suitable heat transfer features for heating and cooling the engine assembly. Advantageously, such engine assemblies also may result in an improvement in noise, vibration and harshness. While the engine assemblies described herein are particularly suitable for use in components of an automobile, they may also be used in a variety of other vehicles. Non-limiting examples of vehicles that can be manufactured by the current technology include automobiles, tractors, buses, motorcycles, boats, mobile homes, aircrafts (manned and unmanned), campers, and tanks.

Figure 1:
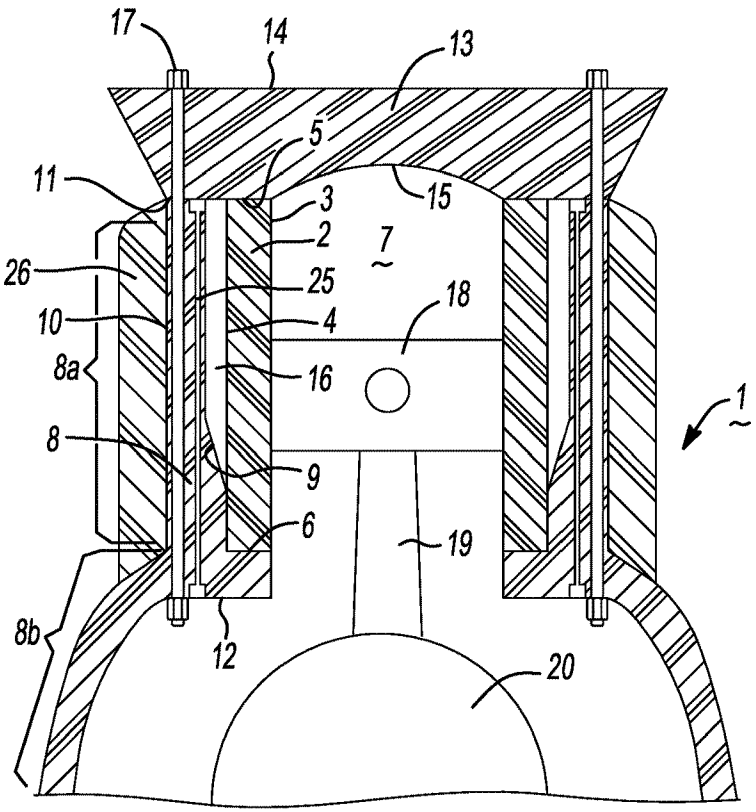
FIG. 1 shows a cross-sectional view of an engine assembly according to certain aspects of the present disclosure.

Thus, the present disclosure contemplates an engine assembly including combinations of traditional metal components, lightweight metal components and/or polymeric composite components as well as heat transfer features for heating and/or cooling the engine assembly. For example, as best shown in FIG. 1, a portion of an engine assembly 1 (e.g., for use in a vehicle) is provided. The engine assembly 1 includes a liner 2, which defines an open void cylindrical region 7. The liner 2 may be any suitable material, such as but not limited to metal (e.g. steel, iron, magnesium alloy, aluminum alloy, metal composite) or ceramic (e.g., alumina, silicon carbide, ceramic composite). In certain variations, the liner 2 is a metal material. The liner 2 generally may be cylindrically shaped and have a hollow interior. The liner 2 has an interior surface 3, an opposing exterior surface 4, a first terminal surface 5 and an opposing second terminal surface 6. The engine assembly 1 also includes a housing 8 disposed around at least a portion of the exterior surface 4 of the liner 2. The housing 8 may also be adjacent to the second terminal surface 6 of the liner 2. The housing 8 has an interior surface 9, an opposing exterior surface 10, a third terminal surface 11, and an opposing fourth terminal surface 12. The housing 8 may be a lightweight metal (e.g., aluminum alloy, magnesium alloy, metal composite), a ceramic material (e.g., alumina, silicon carbide, ceramic composite) or a polymeric composite material. A layer of polymeric composite (e.g., comprising discontinuous fibers) (not shown) may also be present between the exterior surface 4 of the liner 2 and the interior surface 9 of the housing 8.

The engine assembly 1 may further include a cylinder head 13 having a fifth terminal surface 14 and an opposing sixth terminal surface 15. At least a portion of the sixth terminal surface 15 may be adjacent to the first terminal surface 5 of the liner 2. The cylinder head 13 may be any suitable material, such as but not limited to metal (e.g. steel, iron, magnesium alloy, aluminum alloy, metal composite) or ceramic (e.g., alumina, silicon carbide magnesium alloy, aluminum alloy, metal composite)). In certain variations, the cylinder head 13 is a metal material. The liner 2 may be held in place by its contact with the cylinder head 13 and housing 8. A coolant channel 16 may be defined between at least a portion of the exterior surface 4 of the liner 2, an interior surface 9 of the housing 8 and the sixth terminal surface 15 of the cylinder head 13. If more than one liner is present, there may be a continuous coolant channel 16 adjacent to each liner or there may be discrete coolant channels corresponding to each liner. The coolant channel 16 is capable of receiving a suitable heat transfer fluid for cooling the engine assembly 1. Examples of suitable heat transfer fluids include, but are not limited to air, water, oil, ethylene glycol, propylene glycol, glycerol, methanol, and combinations thereof. The air may be supplied from an air conditioning system or produced from movement of the vehicle. In particular, the heat transfer fluid is a mixture of water and ethylene glycol. As shown in FIG. 8, the heat transfer fluid may be supplied by at least one pump 72 from at least one supply reservoir 71 or supply channel to at least one inlet (not shown) in the coolant channel 16 in the engine assembly 1. The heat transfer fluid may be circulated through the coolant channel 16 at a temperature of about 70° C. to about 140° C., about 80° C. to about 130° C., or about 90° C. to about 120° C. The pump and supply reservoir may be present adjacent to the engine assembly. Optionally, the heat transfer fluid may flow through a cooler (not shown) to further reduce the temperature of the heat transfer fluid. One of ordinary skill in the art appreciates that the heat transfer fluid may be supplied to one or more coolant channels as necessary.

The cylinder head 13, housing 8 and/or liner 2 may be coupled together by any suitable fasteners. For example, a plurality of fasteners 17 (e.g. bolts) may join together the cylinder head 13 and the housing 8. The plurality of fasteners 17 may comprise any suitable material, such as, but not limited to, metal, polymeric composites and combinations thereof. Additionally or alternatively, a suitable sealant (not shown) and/or gasket (not shown) may be present between at least a portion of the sixth terminal surface 15 of the cylinder head 13, at least a portion of the first terminal surface 5 of the liner 2, and/or a least a portion of the third terminal surface 11 of the housing 8.

The cylindrical region 7 defined by the liner 2 may receive a piston 18. The piston 18 is connected to a crankshaft 20 via a connecting rod 19. The piston 18, connecting rod 19, and the crankshaft 20 may be any suitable material, e.g., metal, ceramic, polymeric composite, and combinations thereof. As will be appreciated by those of skill in the art, the engine assembly 1 shown in FIG. 1 depicts a single piston 18 and single cylindrical region 7 and associated componentry, but may in fact include a plurality of pistons, cylindrical regions 7, and associated components described above.

Figure 2:
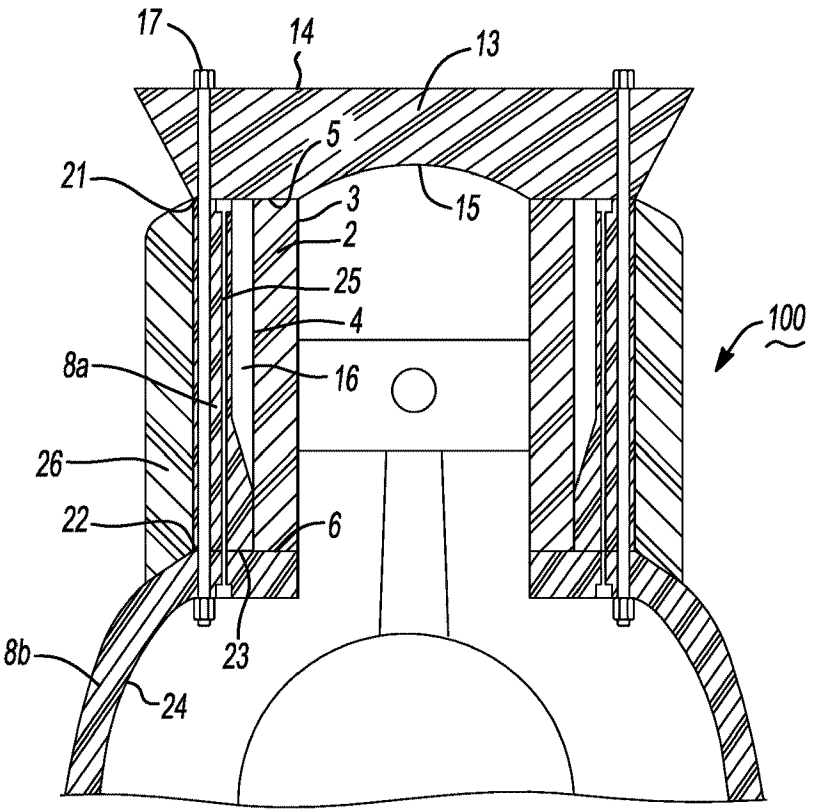
FIG. 2 shows a cross-sectional view of an alternative engine assembly according to certain aspects of the present disclosure.

In various embodiments, the housing 8 comprises a cylinder housing portion 8*a* and crank housing portion 8*b*. The cylinder housing portion 8*a* and the crank housing portion 8*b* may be integrally formed, as shown in FIG. 1. Alternatively, as shown in FIG. 2, the cylinder housing portion 8*a* and the crank housing portion 8*b* may be distinct components joined together via an adhesive (not shown) or with a plurality of fasteners 17 in engine assembly 100. When present as distinct components, the cylinder housing portion 8*a* and the crank housing portion 8*b* may be the same or different material. With reference to FIG. 2, the cylinder housing portion 8*a* has a seventh terminal surface 21 and an opposing eighth terminal surface 22. The crank housing portion 8*b* has a ninth terminal surface 23 and an opposing tenth terminal surface 24. The ninth terminal surface 23 of the crank housing portion is adjacent to the second terminal surface 6 of the liner 2 and the eighth terminal surface 22 of the cylinder housing portion 8*a*. The seventh terminal surface 21 of the cylinder housing portion 8*a* may be adjacent to the sixth terminal surface 15 of the cylinder head 13. The cylinder head 13, cylinder housing portion 8*a*, the crank housing portion 8*b*, and/or liner 2 may be coupled together by any suitable fasteners as described herein. For example, a plurality of fasteners 17 (e.g. bolts) may join together the cylinder head 13, the cylinder housing portion 8*a*, and the crank housing portion 8*b*. The plurality of fasteners 17 may comprise any suitable material, such as, but not limited to, metal, polymeric composites and combinations thereof. Additionally or alternatively, a suitable sealant (not shown) and/or gasket (not shown) may be present between at least a portion of the sixth terminal surface 15 of the cylinder head 13, at least a portion of the first terminal surface 5 of the liner 2, and/or a least a portion of the seventh terminal surface 21 of the cylinder housing portion 8*a*.

In certain aspects, the housing 8 is a polymeric composite material. In such instances, the housing 8 may comprise a suitable polymer and plurality of suitable reinforcing fibers. Examples of suitable polymers include, but are not limited to a thermoset resin, a thermoplastic resin, elastomer and combination thereof. Preferable polymers include, but are not limited to epoxies, phenolics, vinylesters, bismaleimides, polyether ether ketone (PEEK), polyamides, polyimides and polyamideimides. Examples of suitable reinforcing fibers include, but are not limited to carbon fibers, glass fibers, aramid fibers, polyethylene fibers, organic fibers, metallic fibers, and combinations thereof. In particular, the reinforcing fibers are glass fibers and/or carbon fibers. The reinforcing fibers may be continuous fibers. Advantageously, the housing 8 comprising a polymeric composite material as described herein may have a compression strength of about 100 MPa to about 2000 MPa, about 500 MPa to about 1000 MPa or about 1000 MPa to about 1500 MPa.

In order to heat and/or cool the engine assembly 1, the housing 8 (e.g., polymeric composite) can further include a plurality of microchannels 25, as shown in FIG. 1, for receiving a heat transfer fluid as described herein. As shown in one embodiment in FIG. 8, the heat transfer fluid may be supplied by at least one pump 82 from at least one supply reservoir 81 or supply channel to at least one inlet (not shown) in the microchannels 25 in the engine assembly 1. The pump and supply reservoir may be present adjacent to the engine assembly. The heat transfer fluid may be supplied at a suitable temperature to cool and/or heat the engine assembly, e.g., about 10° C. to about 120° C., about 20° C. to about 100° C. or about 20° C. to about 90° C. Optionally, the heat transfer fluid may flow through a cooler (not shown) to further reduce the temperature of the heat transfer fluid or the heat transfer fluid may flow through a heater (not shown) to increase the temperature of the heat transfer fluid. As shown in FIG. 8, the coolant channel 16 and microchannels 25 are supplied separately by supply reservoir 71 and supply reservoir 81. It is contemplated herein, that the coolant channel 16 and microchannels 25 may supplied by the same supply reservoir (not shown). Further, it is contemplated herein, that the engine assembly may comprise the microchannels 25 and associated components (e.g., pump 82, supply reservoir 81 and the like), the coolant channel 16 and associated components (e.g., pump 72, supply reservoir 71 and the like), or a combination thereof.

The microchannels 25 may have a substantially round cross-section. As understood herein, "substantially round" may include circular and oval cross-sections and the dimensions of the cross-section may deviate in some aspects. The microchannels 25 may have a diameter of less than about 8,000 μm. Additionally or alternatively, the microchannels 25 have a diameter of about 0.1 μm to about 8,000 μm, 0.1 μm to about 5,000 μm, 0.1 μm to about 1,000 μm, about 1 μm to about 500 μm or about 1 μm to about 200 μm. Additionally or alternatively, the microchannels 25 may have a substantially rectangular cross-section. As understood herein, "substantially rectangular" may include square cross-sections and the dimensions of the cross-section may deviate in some aspects. Preferably, at least a portion of the microchannels 25 are interconnected, which may prevent blockages. The microchannels 25 may be oriented in any suitable direction, for example, axially, radially, spiral, branched, intersecting, criss-crossing and combinations thereof.

Polymeric composites can be formed by using strips of the composite precursor material, such as a fiber-based material (e.g., cloth or graphite tape). The composite may be formed with one or more layers, where each layer can be formed from contacting and/or overlapping strips of the fiber-based material. The fiber-based substrate material may also comprise a resin. The resin can be solidified (e.g., cured or reacted) after the fiber-based material is applied to the work surface (e.g., opposing exterior surface 4 of liner 2) and thus can serve to bond single or multiple layers together in the polymeric composite.

Various methods are typically employed for introducing resin to impregnated fiber-based substrate composite material systems: wet winding (or layup), pre-impregnating (referred to as "pre-preg"), and resin transfer molding. For wet winding, a dry fiber reinforcement material can be wetted with the resin as it is used, usually by submersion through a bath. For pre-impregnating (pre-preg), the resin is wetted into the fiber-based material in advance, and usually includes a step of partially curing the resin to have a viscous or tacky consistency (also known as a B-stage partial cure), and then winding up the pre-preg fiber-based material for later use. Pre-preg composite material systems tend to use thermoset resin systems, which can be cured or reacted by elevated temperatures with cure or reaction times ranging from about 1 minute to about 2 hours (depending on the cure or reaction temperatures). However, some pre-preg materials may employ resins that cure or react with actinic radiation (e.g., ultraviolet radiation (UV)). For resin transfer molding, dry fiber reinforcement material may be placed into a mold and resin may be infused into the mold under pressure (e.g., about 10 psi to about 2000 psi). Injection molding techniques known in the art may also be used to introduce resin into the reinforcement material, particularly where the reinforcement material comprise discontinuous fibers. For example, a precursor comprising a resin and the reinforcement material may be injected or infused into a defined space or mold followed by solidification of the precursor to form the polymeric composite material. The term "injection molding" also includes reaction injection molding using at thermoset resin. In certain other aspects, the present teachings also contemplate an attaching step where a reinforcement material is applied, for example, via filament winding, braiding or weaving near, within, and/or over the work surface (e.g., opposing exterior surface 4 of liner). The method may optionally comprise applying or introducing an uncured or unreacted resin composition into or onto the fiber-based reinforcement material. By applying, it is meant that the uncured or unreacted resin composition is wetted out onto the fiber-based material and thus may be coated on a surface of the fiber-based material or imbibed/impregnated into the reinforcement fiber-based material (for example, into the pores or openings within the reinforcement fiber-based material). After the resin is introduced to the regions having the reinforcement material, followed by solidifying (e.g., curing or reacting) to form the polymeric composite. Pre-preg fiber-based material may be applied via filament winding, braiding or weaving as well.

Figure 3A:
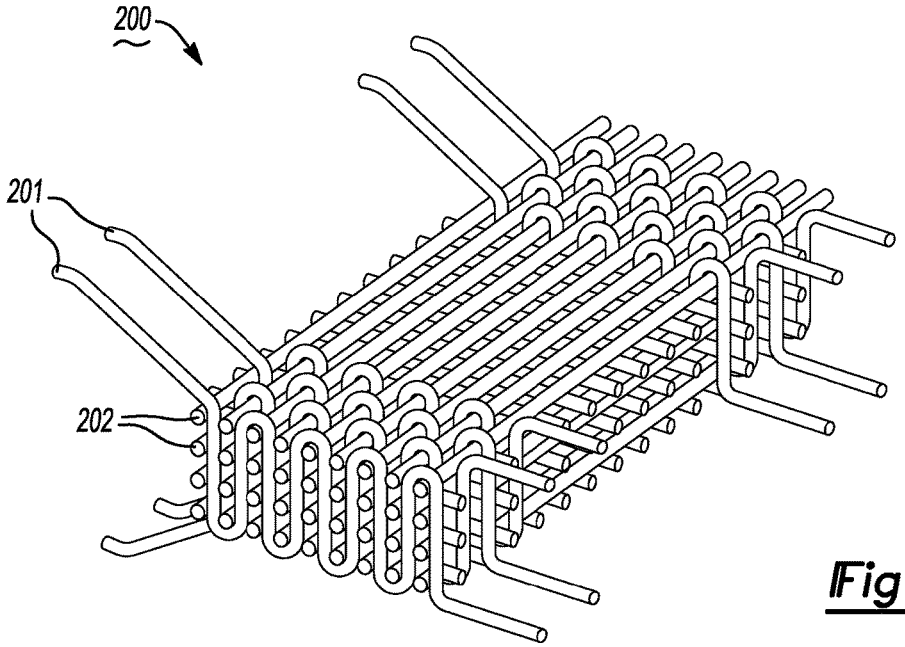
Figure 3B:
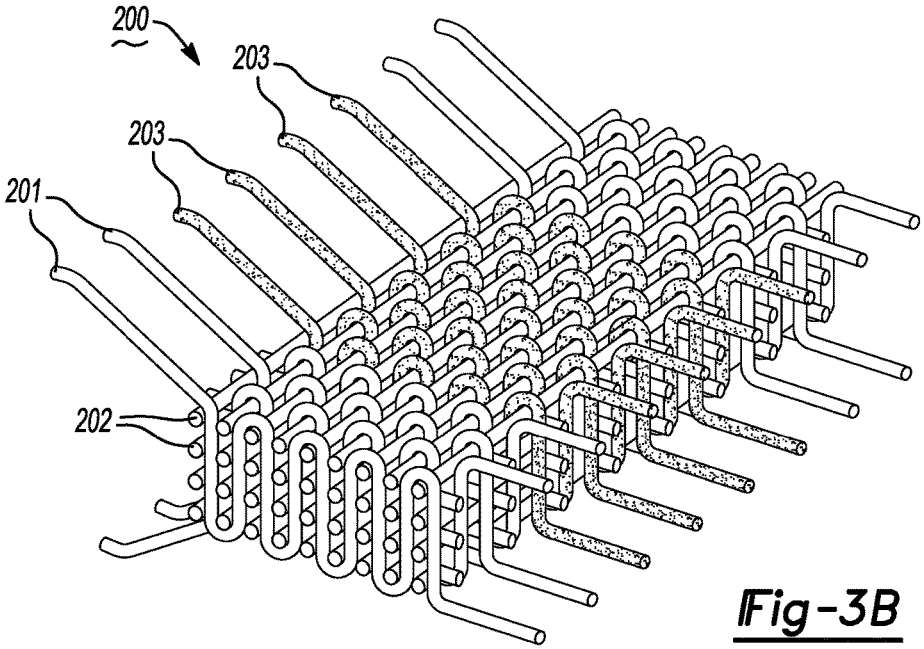

In certain other aspects, the present teaching also contemplates a process of using sacrificial fibers to form the microchannels 25 in the polymeric composite (e.g., housing 8). As shown in FIG. 3*a*, a composite woven preform 200 comprises interwoven first reinforcing fibers 201 (e.g., carbon fibers, glass fibers) and second reinforcing fibers 202 (e.g., carbon fibers, glass fibers) to form a three dimensional woven structure. The first reinforcing fibers 201 and the second reinforcing fibers 202 can be the same or different fibers. Sacrificial fibers 203 can be woven into the composite woven preform 200 along with the first reinforcing fibers 201, as shown in FIG. 3*b*. The first reinforcing fibers 201 and the sacrificial fibers 203 can be directed through the second reinforcing fibers 202 sinusoidally. It should be noted that other weaving patterns are also contemplated and not limited to the patterns shown in FIGS. 3*a*-3*e*, which are merely example embodiments. The sacrificial fibers 203 comprises a material, which can withstand weaving with the first reinforcing fibers 201 and/or second reinforcing fibers 202 as well as solidification of the polymeric composite (e.g., resin infusion and curing), but is capable of vaporizing, melting, etching or dissolving under conditions which do not substantially vaporize, melt, etch or dissolve other components of the polymeric composite (e.g., reinforcing fibers). Examples of suitable sacrificial fiber materials include, but are not limited to metals and polymers. Non-limiting metals may include solders, which comprise lead, tin, zinc, aluminum, suitable alloys and the like. Non-limiting polymers may include polyvinyl acetate, polylactic acid, polyethylene, polystyrene. Additionally or alternatively, the sacrificial fibers may further be treated with a catalyst or chemically modified to alter melting or degradation behavior.

Figure 3C:
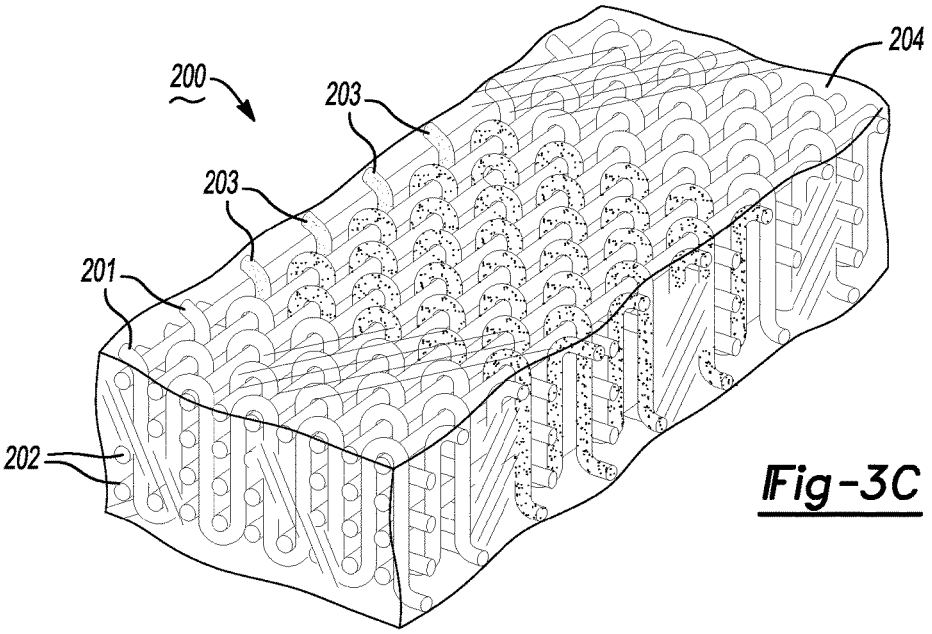
Figure 3D:
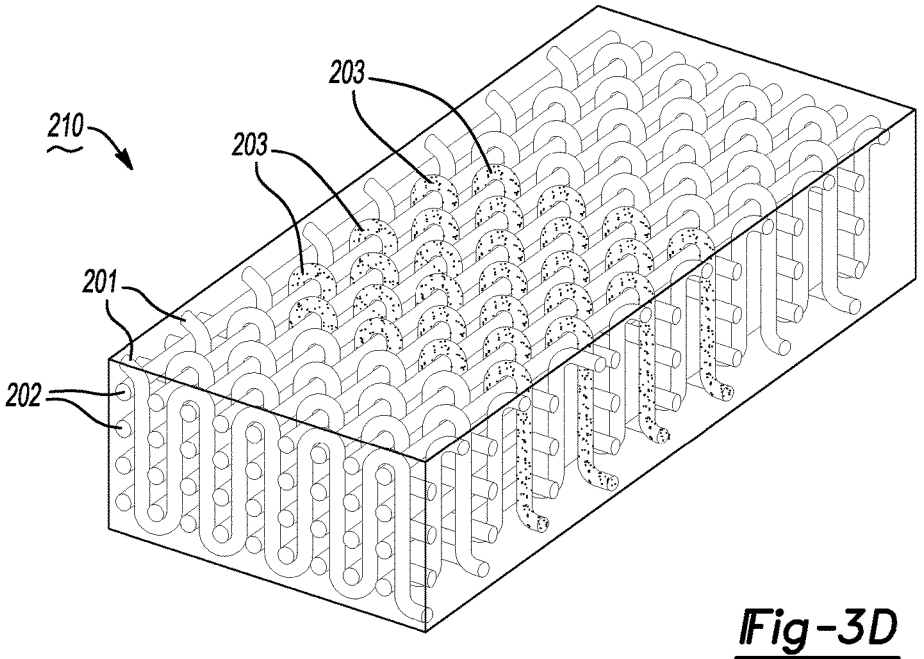
Figure 3E:
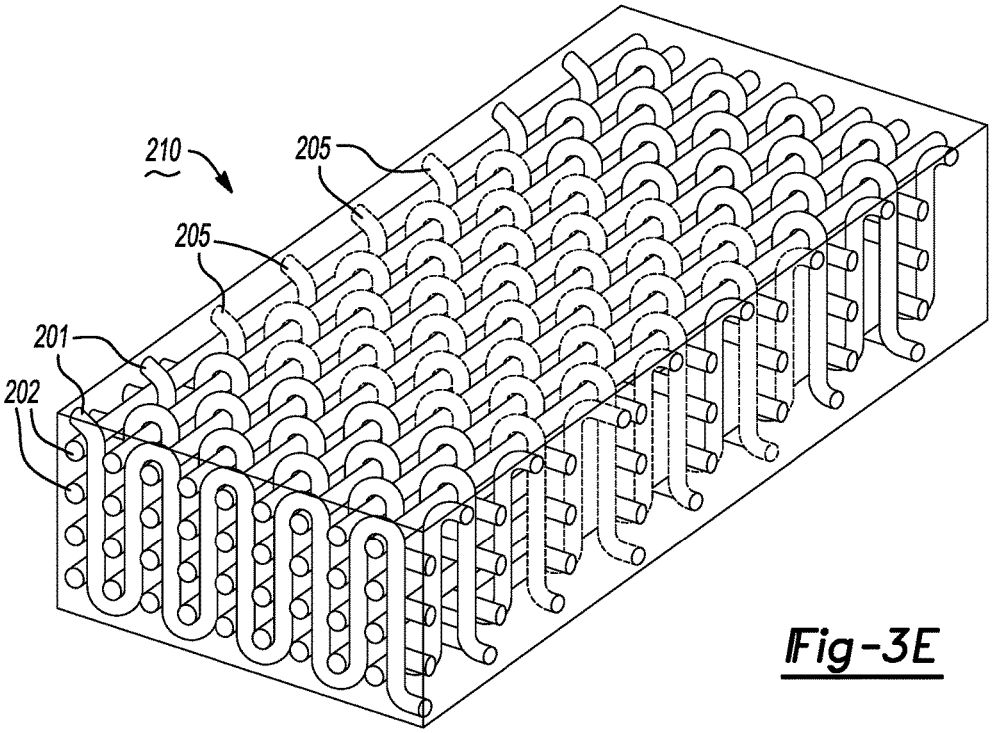

Following incorporation of the sacrificial fibers 203, a resin 204 is infused into the preform 200 and the preform 200 is solidified (e.g., reacted or cured) under suitable conditions, as shown in FIGS. 3*c* and 3*d*, respectively, to form polymeric composite 210. After solidifying (e.g., reacting or curing), the polymeric composite 210 may be further treated (e.g., heated) to volatilize, melt, or degrade the sacrificial fibers 203 or the sacrificial fibers 203 may be dissolved to produce degradants. For example, the sacrificial fibers may be heated to a temperature (e.g., about 150° C. to about 200° C.) that substantially vaporizes or melts the sacrificial fibers but does not substantially degrade the reinforcing fibers and/or the solidified resin. Any suitable solvent, such as, but not limited to acetone, may be applied to the sacrificial fibers to dissolve them, optionally with agitation, so long as the solvent does not substantially degrade or dissolve the reinforcing fibers and/or the cured resin. Alternatively, the sacrificial fibers may be etched using a suitable acid (e.g., hydrochloric acid, sulfuric acid, nitric acid, and the like). The degradants may be removed to form microchannels 205 in the polymeric composite 210, e.g., by applying a vacuum to the polymeric composite or introducing a gas to the polymeric composite to expel the degradants out of the polymeric composite. It also contemplated herein that the microchannels may be present in a non-polymeric composite housing, for example, in a metal housing or a ceramic housing.

In other variations, a composite precursor material may be injection molded or otherwise applied to the opposing exterior surface 4 of liner 2, which may be followed by solidification (e.g., curing or reacting) to form the housing 8.

Additionally or alternatively, the polymeric composite (e.g., housing 8) may include a plurality of microspheres (not shown) for improved heat transfer. The microspheres may be ceramic or glass, and optionally, may be coated with a metal, ceramic and/or nanoparticles. Preferably, the coating has a high thermal conductivity, e.g., aluminum, copper, tin and the like. The microspheres may have a diameter of less than about 1,000 μm. Additionally or alternatively, the microspheres have a diameter of about 0.1 μm to about 1,000 μm, about 1 μm to about 500 μm or about 1 μm to about 200 μm.

Additionally or alternatively, the polymeric composite (e.g., housing 8) may include at least one wire for heating the engine assembly. For example, as shown in FIG. 4, one or more wires 302 may be incorporated or woven into reinforcing fibers 301 (e.g., carbon fibers) in the polymeric composite 300 (e.g., housing 8). The wires 302 may be comprise any material suitable for conducting electricity (e.g., copper, Nichrome, and the like). The wires 302 may be insulated from the reinforcing fibers 301. For example, the wires 302 may include a suitable insulative coating, such as a polymer coating and/or a braided glass fiber sheath. To heat the wires 302, electricity is provided by a battery or other suitable external source (not shown) and controlled by a control unit (not shown). Referring to FIG. 1 for example, although not shown, a person of ordinary skill in the art appreciates that the wires 302 may be included in the housing 8 in addition to or instead of the plurality of microchannels 25.

In a particular embodiment, the polymeric composite housing comprises one or more of: (i) a plurality of microchannels as described herein; (ii) at least one wire as described herein; and (iii) a plurality of microspheres as described herein. Additionally or alternatively, the polymeric composite housing comprises two or more of (i), (ii) and (iii) (e.g., (i) and (ii), (i) and (iii), (ii) and (iii)). Additionally or alternatively, the polymeric composite housing comprises (i), (ii) and (iii).

Referring back to FIG. 1, the engine assembly 1 may further include a polymeric composite layer 26 disposed around at least a portion of the exterior surface 10 of the housing 8. The polymeric composite layer 26 may serve as a mechanical, chemical and/or thermal shield for the engine assembly. The polymeric composite layer 26 may comprise a suitable polymer as described herein (e.g., thermoset resin, thermoplastic resin, elastomer) and a plurality of suitable reinforcing fibers (e.g., carbon fibers, glass fibers, aramid fibers, polyethylene fibers, ceramic fibers, organic fibers, metallic fibers, and combinations thereof). In particular, the reinforcing fibers are glass fibers and/or carbon fibers. The reinforcing fibers may be discontinuous fibers. The polymeric composite layer 26 may be formed by injection molding. Additionally or alternatively, the polymeric composite layer 26 may extend around at least a portion of the cylinder head 13, as shown in FIG. 5. Further, as shown in FIG. 5 in an alternative engine assembly 50, the polymeric composite layer 26 may extend along substantially all of the exterior surface 10 of the housing 8. Additionally or alternatively, the polymeric composite layer 26 may extend around any other suitable surface of the vehicle assembly, e.g., around an oil pan, around a cam cover. Additionally or alternatively, the polymeric composite layer 26 may extend around any peripheral systems of the vehicle assembly, e.g., water pump, air conditioner, turbocharger. Alternatively, it is contemplated herein, that instead of utilizing a polymeric composite layer 26, a metal layer or ceramic layer may be used in its place. Such a polymeric composite layer 26, metal layer or ceramic layer may seal the outside of the engine assembly and prevent leakage of fluid from between the various components in the engine assembly and may avoid the need for the use of gaskets for sealing the engine assembly.

In other variations, polymeric composites used herein for the housing 8 and/or the polymeric composite layer 26 may be made by any other suitable methods known in the art, e.g., pultrusion, reaction injection molding, injection molding, compression molding, prepreg molding (in autoclave or as compression molding), resin transfer molding, and vacuum assisted resin transfer molding. Further, fiber precursors may be made by any other suitable methods known in the art, e.g., braiding, weaving, stitching, knitting, prepregging, hand-layup and robotic or hand placement of tows.

In various aspects, as shown in FIGS. 6*a* and 6*b*, an engine assembly 400 is contemplated, which includes a cap 27. The cap 27 may be adjacent to a third terminal surface 11 of the housing 8 and the sixth terminal surface 15 of the cylinder head 13. The cap 27 may be any suitable material, such as a metal, ceramic, or polymeric composite material. In particular, the cap 27 is metal (e.g., steel, iron, magnesium alloy, aluminum alloy), especially when the housing 8 is a polymeric composite because cap 27 may be more machinable than the polymeric composite. The cap 27 may serve as a mating surface between the cylinder head 13 and the housing 8. Preferably, the cap 27 and the liner 2 are the same material (e.g., metal) so that they may both be machined or formed together in preparation for a head gasket and/or the cylinder head 13. The cap 27 may be joined to the housing 8 with a suitable adhesive or directly molded with the housing 8. Additionally or alternatively, the fastener 17 may couple together the cylinder head 13, the cap 27 and/or the housing 8. Additionally or alternatively, a second cap (not shown) similar to the cap 27 may be adjacent to the eighth terminal surface 22 of the cylinder housing portion 8*a* and the ninth terminal surface 23 of the crank housing portion 8*b*.

In other variations, it is further contemplated that one or more of the engine assembly components described herein include one or more mechanical interlock features for coupling together the various engine components. For example, complementary protruding flanges, grooves, channels, locking wings of differing shapes could be used as mechanical interlock features. In particular, as shown in FIG. 7 in alternative engine assembly 60, at least a portion of the exterior surface 4 of the liner 2 may comprise one or more mechanical interlock features 28 for coupling with the housing 8 (e.g., interior surface 9), particularly where the housing 8 is a polymeric composite material. Additionally or alternatively, the cap 27 and or the third terminal surface 11 of the housing 8 may include one or more mechanical interlock (not shown) features for coupling the cap 27 with the housing 8. Additionally or alternatively, ceramic material may be present between various metal and polymeric composite components in the engine assembly for insulation purposes. It is understood herein that the various metal components described herein can be readily machined or cast.

In one particular embodiment, the present disclosure contemplates an engine assembly (e.g., engine block) comprising: a metal liner defining a cylindrical region for receiving a piston, wherein the metal liner has an interior surface, an opposing exterior surface, a first terminal surface and an opposing second terminal surface; a polymeric composite housing disposed around at least a portion of the exterior surface of the metal liner, wherein the polymeric composite housing comprises a polymer as described herein (e.g., thermoplastic or thermoset resin) and a plurality reinforcing fibers as described herein (e.g., carbon fibers, glass fibers, aramid fibers, polyethylene fibers, ceramic fibers, organic fibers, metallic fibers, and combinations thereof) and at least one of: (i) a plurality of microchannels as described herein for receiving a heat transfer fluid as described herein for heating and/or cooling the engine assembly; and (ii) at least one wire as described herein for heating the engine assembly; and a metal cylinder head having a third terminal surface and an opposing fourth terminal surface, wherein the fourth terminal surface of the metal cylinder head is adjacent to the first terminal surface of the metal liner. The polymeric composite housing may comprise a cylinder housing portion as described herein and a crank housing portion as described herein. Additionally or alternatively, the engine assembly may further comprise a coolant channel as described herein defined between at least a portion of the exterior surface of the metal liner, an interior surface of the polymeric composite housing and the fourth terminal surface of the metal cylinder head. Additionally or alternatively, the engine assembly may further comprise a polymeric composite layer as described herein (e.g., discontinuous carbon fibers) disposed around at least a portion of an exterior surface of the polymeric composite housing and/or extending around at least a portion of the metal cylinder head. Additionally or alternatively, the engine assembly may further comprise a metal cap in communication with a ninth terminal surface of the polymeric composite housing and the fourth terminal surface of the metal cylinder head. Additionally or alternatively, the exterior surface of the metal liner may comprise one or more mechanical interlock features as described herein to couple with the polymeric composite housing.

As discussed above, during internal combustion, engine assemblies are subjected to varying amounts of stresses as well as temperature extremes. Thus, in other various embodiments, the present disclosure contemplates methods of heating/or cooling an engine assembly as described herein (e.g., engine assembly 1). The method may comprise circulating a suitable heat transfer fluid as described herein (e.g., air water, oil, ethylene glycol, propylene glycol, glycerol, methanol, and the like) for heating or cooling the engine assembly through a plurality of microchannels (e.g., microchannels 25) as described herein disposed in a housing as described herein (e.g., housing 8). The heat transfer fluid may be supplied by a pump from at least one reservoir or supply channel to at least one inlet in the microchannels. This system and process may be referred to as a first heating and cooling loop in the engine assembly. In various aspects, the heat transfer fluid may be introduced to the microchannels at temperatures suitable for heating or cooling the engine assembly. For example, if the heat transfer fluid is a liquid, it may be introduced and circulated through the microchannels at temperature between its freezing point and boiling point. Alternatively, if the heat transfer fluid is a gas, it may be introduced and circulated through the microchannels at a temperature above the condensation temperature of the gas. Non-limiting examples of temperatures at which the heat transfer fluid may be introduced into and/or circulated through the microchannels are about 10° C. to about 120° C., about 20° C. to about 100° C. or about 20° C. to about 90° C.

The housing may be formed of a lightweight metal (e.g., aluminum alloy, magnesium alloy), a ceramic material (e.g., alumina, silicon carbide) or a polymeric composite material as described herein. In particular, the housing is a polymeric composite material comprising a polymer as described herein (e.g., thermoset, thermoplastic resin) and a plurality reinforcing fibers (e.g., carbon fibers, glass fibers, metallic fibers, and the like). The housing may be disposed around at least a portion of an exterior surface of a liner as described herein (e.g., liner 2), wherein the liner defines a cylindrical region for receiving a piston as described herein (e.g., piston 18). The liner may be any suitable material, e.g. metal or ceramic. In particular, the liner is metal.

Additionally or alternatively, the methods may include applying an electrical current to at least one wire as described herein (e.g., wires 302) disposed in the housing as described herein (e.g., housing 8) for heating the engine assembly. Electricity may be provided by a battery or other suitable external source and controlled by a control unit. For example, the engine assembly may be heated to temperatures of about 200° C. to about 350° C., about 200° C. to about 250° C. or about 250° C. to about 350° C. This system and process may be referred to as a second heating loop in the engine assembly. Additionally or alternatively, the methods may further include incorporating a plurality of microspheres as described herein in the housing (e.g., housing 8) for improving heat transfer in the engine assembly.

In various aspects, the method may further comprise circulating a second heat transfer fluid as described herein (e.g., air, water, oil, ethylene glycol, propylene glycol, glycerol, methanol, and the like) to a coolant channel as described herein (e.g., coolant channel 16) for cooling the engine assembly. The second heat transfer fluid may be the same or different than the heat transfer fluid supplied to the microchannels in the housing. The coolant channel may be defined between at least a portion of an exterior surface (e.g., exterior surface 4) of the liner (e.g., liner 2), an interior surface (e.g., interior surface 9) of the housing (e.g., housing 8) and a terminal surface (e.g., sixth terminal surface 15) of a cylinder head (e.g., cylinder head 13). The heat transfer fluid may be supplied by a pump from at least one reservoir or supply channel to at least one inlet in the coolant channel 16 in the engine assembly. This system and process may be referred to as a third cooling loop in the engine assembly. The heat transfer fluid may circulate through the fourth cooling loop at any suitable temperature, for example, from the environmental temperature up to about 120° C. As used herein, "environmental temperature" refers to ambient temperature of the vehicle. The environmental temperature prior to operation may in certain examples range from about −40° C. to about 50° C. It is understood herein the method may include one or more of the first heating and cooling loop, the second heating loop, and the third cooling loop.

In one particular embodiment, a method for heating and/or cooling an engine assembly, wherein the method comprises one or more of the following: (i) circulating a heat transfer fluid for heating or cooling the engine assembly through a plurality a microchannels disposed in a polymeric composite housing comprising a polymer as described herein (e.g., thermoplastic or thermoset resin) and a plurality reinforcing fibers as described herein (e.g., carbon fibers, glass fibers, aramid fibers, polyethylene fibers, ceramic fibers, organic fibers, metallic fibers, and combinations thereof) disposed around at least a portion of an exterior surface of a metal liner, wherein the metal liner defines a cylindrical region for receiving a piston; and (ii) applying an electrical current to at least one wire as described herein disposed in the polymeric composite housing for heating the engine assembly. Additionally or alternatively, the heat transfer fluid may be introduced to the microchannels at a temperature of from the environmental temperature as described herein up to about 120° C. For example, the heat transfer fluid may be introduced to the microchannels at a temperature of about −40° C. to about 120° C., about −30° C. to about 120° C., about 0.0° C. to about 120° C., about −20° C. to about 90° C., about 10° C. to about 120° C., about 20° C. to about 100° C. or about 20° C. to about 90° C. Additionally or alternatively, the method may further comprise circulating another heat transfer fluid as described herein to a coolant channel defined between at least a portion of the exterior surface of the metal liner, an interior surface of the polymeric composite housing and a fourth terminal surface of a metal cylinder head.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An engine assembly comprising:

a metal liner defining a cylindrical region for receiving a piston, wherein the metal liner has an interior surface, an opposing exterior surface, a first terminal surface and an opposing second terminal surface;

a polymeric composite housing disposed around at least a portion of the exterior surface of the metal liner, wherein the polymeric composite housing comprises a polymer and a plurality of reinforcing fibers and at least one of:

(i) a plurality of microchannels for receiving a heat transfer fluid for heating and/or cooling the engine assembly; and (ii) at least one wire for heating the engine assembly; and a metal cylinder head having a fifth terminal surface and an opposing sixth terminal surface, wherein at least a portion of the sixth terminal surface of the metal cylinder head is adjacent to at least a portion of the first terminal surface of the metal liner.

2. The engine assembly of claim 1 further comprising a coolant channel defined between at least a portion of the exterior surface of the metal liner, an interior surface of the polymeric composite housing and the fourth terminal surface of the metal cylinder head.

3. The engine assembly of claim 1 further comprising a polymeric composite layer disposed around at least a portion of an exterior surface of the polymeric composite housing.

4. The engine assembly of claim 3, wherein the polymeric composite layer extends around at least a portion of the metal cylinder head.

5. The engine assembly of claim 3, wherein the polymeric composite layer comprises discontinuous carbon fibers.

6. The engine assembly of claim 1, wherein the polymeric composite housing comprises a cylinder housing portion having a seventh terminal surface and an opposing eighth terminal surface and a crank housing portion having a ninth terminal surface and an opposing tenth terminal surface, wherein the ninth terminal surface of the crank housing portion is adjacent to the second terminal surface of the metal liner and the eighth terminal surface of the cylinder housing portion, and wherein the cylinder housing portion and the crank housing portion are integral or distinct components joined together.

7. The engine assembly of claim 1 further comprising a metal cap adjacent to a third terminal surface of the polymeric composite housing and the sixth terminal surface of the metal cylinder head.

8. The engine assembly of claim 1 wherein the exterior surface of the metal liner comprises one or more mechanical interlock features to couple with the polymeric composite housing.

9. The engine assembly of claim 1, wherein the polymer in the polymeric composite housing comprises a thermoplastic resin or thermoset resin and the plurality of reinforcing fibers are continuous fibers selected from the group consisting of: carbon fibers, glass fibers, aramid fibers, polymeric fibers, metallic fibers and a combination thereof.

10. The engine assembly of claim 1, wherein the plurality of microchannels in the polymeric composite housing are oriented axially, radially, branched, intersecting, criss-crossing or in a spiral direction.

11. A method for heating and/or cooling an engine assembly, wherein the method comprises one or more of the following:

(i) circulating a heat transfer fluid for heating or cooling the engine assembly through a plurality a microchannels, wherein the engine assembly comprises:

a metal liner defining a cylindrical region for receiving a piston, wherein the metal liner has an interior surface, an opposing exterior surface, a first terminal surface and an opposing second terminal surface;

a polymeric composite housing disposed around at least a portion of the exterior surface of the metal liner, wherein the polymeric composite housing comprises a polymer and a plurality of reinforcing fibers; and a metal cylinder head having a fifth terminal surface and an opposing sixth terminal surface, wherein at least a portion of the sixth terminal surface of the metal cylinder head is adjacent to at least a portion of the first terminal surface of the metal liner; and wherein the plurality a microchannels are disposed in the polymeric composite housing; and (ii) applying an electrical current to at least one wire disposed in the polymeric composite housing for heating the engine assembly.

12. The method of claim 11, wherein the polymer in the polymeric composite housing comprises a thermoplastic resin or thermoset resin and the plurality of reinforcing fibers are continuous fibers selected from the group consisting of: carbon fibers, glass fibers, aramid fibers, polymeric fibers, metallic fibers and a combination thereof.

13. The method of claim 11 further comprising circulating a second heat transfer fluid to a coolant channel defined between at least a portion of the exterior surface of the metal liner, an interior surface of the polymeric composite housing and a fourth terminal surface of a metal cylinder head.

14. The method of claim 11, wherein the heat transfer fluid is introduced to the microchannels at a temperature of about −20° C. to about 90° C.

15. The engine assembly of claim 3, wherein the polymeric composite layer extends along substantially all of the exterior surface of the polymeric composite housing.

16. The engine assembly of claim 1, wherein the polymeric composite housing comprises the plurality of microchannels the plurality of microchannels are interconnected.

17. The engine assembly of claim 1, wherein the polymeric composite housing comprises the least one wire for heating the engine assembly.

18. The engine assembly of claim 1, wherein the polymeric composite housing has a compression strength of about 100 MPa to about 2000 MPa.

19. The engine assembly of claim 1, wherein the polymeric composite housing further comprises a plurality of microspheres having a diameter of about 0.1 μm to about 1000 μm.

20. An engine assembly comprising:

a metal liner defining a cylindrical region for receiving a piston, wherein the metal liner has an interior surface, an opposing exterior surface, a first terminal surface and an opposing second terminal surface;

a polymeric composite housing disposed around at least a portion of the exterior surface of the metal liner, wherein the polymeric composite housing comprises a polymer and a plurality of reinforcing fibers and at least one of:

(i) a plurality of microchannels for receiving a heat transfer fluid for heating and/or cooling the engine assembly; and (ii) at least one wire for heating the engine assembly; and a metal cylinder head having a fifth terminal surface and an opposing sixth terminal surface, wherein at least a portion of the sixth terminal surface of the metal cylinder head is adjacent to at least a portion of the first terminal surface of the metal liner; and a polymeric composite layer disposed around at least a portion of an exterior surface of the polymeric composite housing.

* * * * *